United States Patent [19]

Uredat-Neuhoff

[11] Patent Number: 4,732,424

[45] Date of Patent: Mar. 22, 1988

[54] SITTING FURNITURE, IN PARTICULAR SWIVEL CHAIR

[76] Inventor: Angela Uredat-Neuhoff, Vosseberge 18, 4592 Linder/Oldenburg, Fed. Rep. of Germany

[21] Appl. No.: 52,136

[22] Filed: May 1, 1987

Related U.S. Application Data

[63] Continuation of Ser. No. 763,697, Aug. 8, 1985, abandoned.

[30] Foreign Application Priority Data

Aug. 8, 1984 [DE] Fed. Rep. of Germany ..... 3429186

[51] Int. Cl.[4] ..... A47C 1/02

[52] U.S. Cl. ..... 297/317; 297/292; 297/301; 297/320; 297/341

[58] Field of Search ..... 297/285, 291, 292, 300–302, 297/317, 320, 322, 332, 333, 341, 342

[56] References Cited

U.S. PATENT DOCUMENTS

| | | | |
|---|---|---|---|
| 601,035 | 3/1898 | Bulkley | 297/375 |
| 1,631,440 | 6/1927 | Turner | 297/333 |
| 2,400,588 | 5/1946 | McArthur | 297/317 |
| 2,611,421 | 9/1952 | Hathaway | 297/317 |
| 3,337,266 | 8/1967 | Burns | 297/317 |
| 3,947,069 | 3/1976 | Lusch | 297/317 |
| 4,451,085 | 5/1984 | Franck et al. | 297/320 X |
| 4,504,090 | 3/1985 | Goldman | 297/317 X |

FOREIGN PATENT DOCUMENTS

| | | | |
|---|---|---|---|
| 1466417 | 1/1967 | France | 297/375 |
| 594389 | 6/1959 | Italy | 297/342 |

*Primary Examiner*—Kenneth J. Dorner
*Assistant Examiner*—Peter R. Brown
*Attorney, Agent, or Firm*—Browdy and Neimark

[57] ABSTRACT

A swivel-chair (10) has a frame (15) on which a seat (24) is movably mounted. A back (22) is connected with the seat (24), and this back (22) may be turned around a connecting point (19) at the frame (15). At this connecting point (19) a rotary spring (40) is provided, which tends to turn the back (22) into its working position, and the seat (24) is supported and guided at a seat-guide (31) at its forward area, that is where the thighs of the user are resting. This seat-guide (31) is preferably made such, that it will keep the inclination of the seat (24) on movement thereof, thus the so-called seat-slope, at an ergonomically advantageous value. A movement into the rest position goes against the rotary spring (40) and if required also the seat-guide (31) Optionally a blocking-device (45) for the seat (24) may also be provided in order to be able to block the seat (24) in any desired position in accordance with the wishes of the user.

15 Claims, 18 Drawing Figures

SITTING FURNITURE, IN PARTICULAR SWIVEL CHAIR

This application is a continuation of application Ser. No. 763,697 filed Aug. 8, 1985, now abandoned.

The invention relates to sitting furniture as is known from laid-open German Patent Application No. 3, 315,273 of applicant. This know sitting furniture has been found useful in practice.

The object of the present invention is to provide an improvement over this known sitting furniture.

According to the invention this object is achieved by integrating a rotary spring in the frame of the sitting furniture, thus making a corresponding area for mounting such a spring underneath the seat superfluous. The term "rotary spring", as used in this disclosure, designates an element that will oppose a twisting of two structural elements with respect to each other by elastic resistance, and will create return force which increases as the displacement-angle increases. The action of the rotary spring may be supported by a corresponding seat guide in the area of the front seat end.

Preferably the seat-guide permits automatic adjustment of the slope of the seat, in order to continuously obtain in the working position and in the rest-position an ergonomically advantageous seat-position. To that end the seat-position is preferably provided with a horizontal or slightly forwardly inclined disposition when in the working position, or with a backward sloping seat-position in the rest-position which prevents slipping of the user from the sitting furniture.

Further details and advantageous additional developments of the invention will follow from the embodiments as described hereafter and as shown in the drawings, in which.

In the description hereafter identical or similar functioning parts are usually indicated with the same or similar reference numerals and are usually described only once.

Figure 1:
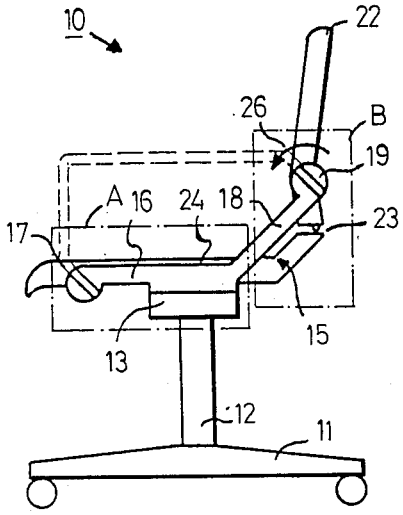
FIG. 1 illustrates a first embodiment of the invention, depicted as a swivel-chair, in side-view and in working position.
Figure 2:
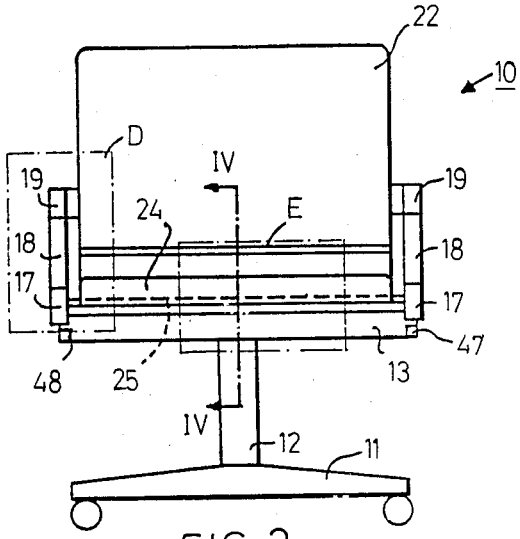
FIG. 2 illustrates the chair according to FIG. 1 in front-view.
Figure 3:
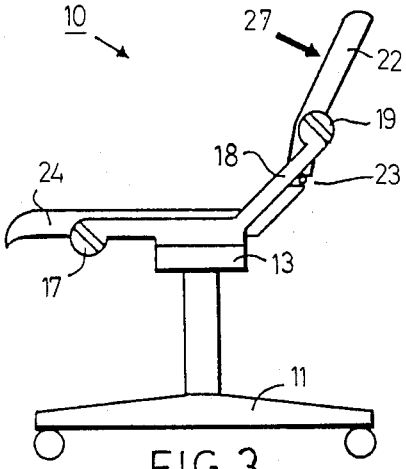
FIG. 3 is a view corresponding with FIG. 1, in which the chair is in its relaxation position (rest-position)

FIGS. 1–3 show schematically a swivel-chair 10 according to the invention, which includes a turn-cross 11 of customary construction, connected with a box-like, internally hollow cross-support 13 by means of a column 12, serving for height adjustment. The support 13 facilitates the incorporation of a blocking-device which will be described in more detail below.

At the cross-support 13 a frame 15 is connected, having at both sides of the seat a horizontal section 16 ending in a forward mounting 17, and a section 18, sloping upwardly and rearwardly at an angle of about 45°, the latter section 18 ending in a mounting 19.

The mountings 19 facilitate the turnable hinging of an upholstered back-piece 22, which is connected at its lower end with a seat-piece 24 by means of a hinge-joint 23. A bar or cross-bar 25 extends transverse to the seat 24 at its front segment, both ends of bar 25 being hinged in the mountings 17 longitudinally displaceable by means of seat-guides. In both mountings 19 a rotary spring is located, which functions to turn the back-piece in the direction of arrow 26 (FIG. 1), when the chair is not occupied and the blocking-device is disengaged. Thus the chair is pulled into its working position, and this is the case until the cross-bar 25 bumps against a cam in mounting 17. This working position is shown in FIG. 1.

When on the other hand the back-piece 22 turns clockwise (with reference to FIG. 1 or 3) by a pressure of the user's shoulders at 27 against it, then the seat-piece 24 is shifted forward, until the cross-bar 25 bumps against its front cam in mounting 17, and at the same time the rotary springs in the mountings 19 are pressed together, thus tightened. This is the relaxation position of the swivel-chair 10, which also in the following text will be referred to as a relaxation position and which is shown in FIG. 3. If the seat is not blocked in this relaxation position, then it will return automatically after the user gets out of the chair to the working position according to FIG. 1, while the rotary springs in the mountings 19 are partially released.

Figure 4:
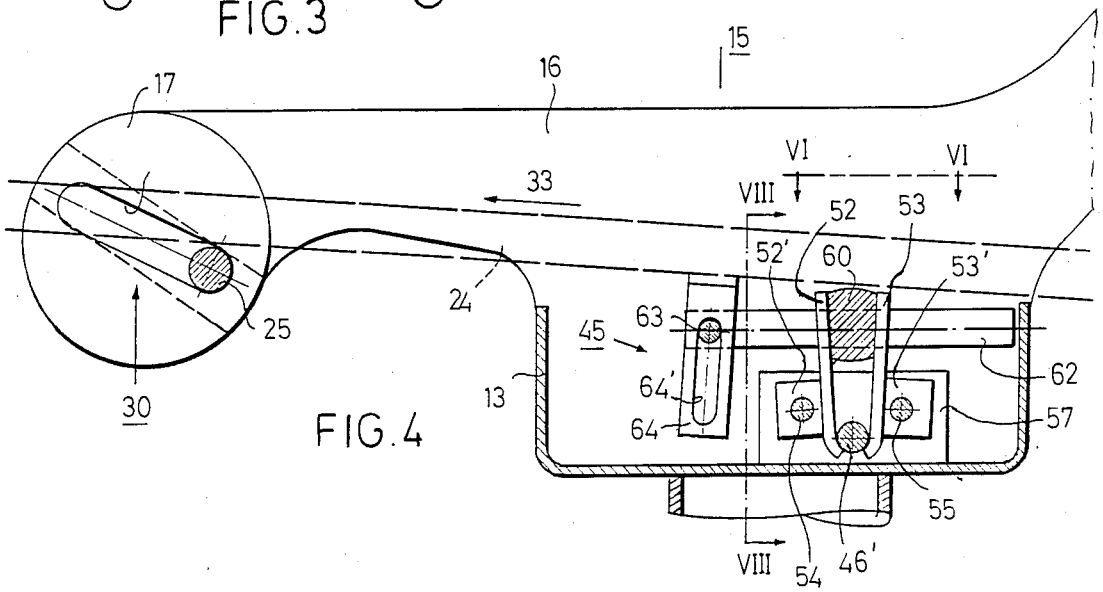
FIG. 4 depicts a section, seen along the line IV—IV of FIG. 2, shown on an enlarged scale which corresponds with the denoted area A, shown with dash-dotted lines in FIG. 1.
Figure 5:
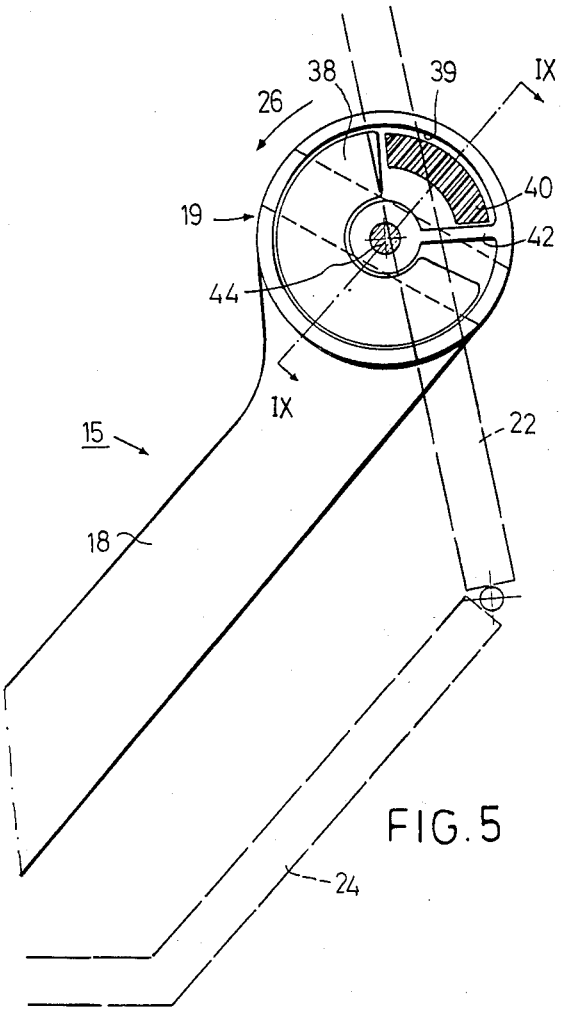
FIG. 5 is a view corresponding with the denoted area B, shown with dash-dotted lines in FIG. 1.

FIG. 4 shows the frame 15 of the swivel-chair 10 with its horizontal section 16, and its mounting 17, while FIG. 5 shows the rising section 18 and its mounting 19. In addition the seat 24 and the back-piece 22 are shown in dash-dotted lines schematically in their working position (similar to FIG. 1).

In mounting 17 is a seat-guide 30 in the form of an obliquely disposed longitudinal hole or slot 31, which guides the cross-bar 25, so that the seat 24 when shifted forward, that is in the direction of arrow 33, is lifted, whereby a corresponding opposing force is created.

Figure 7:
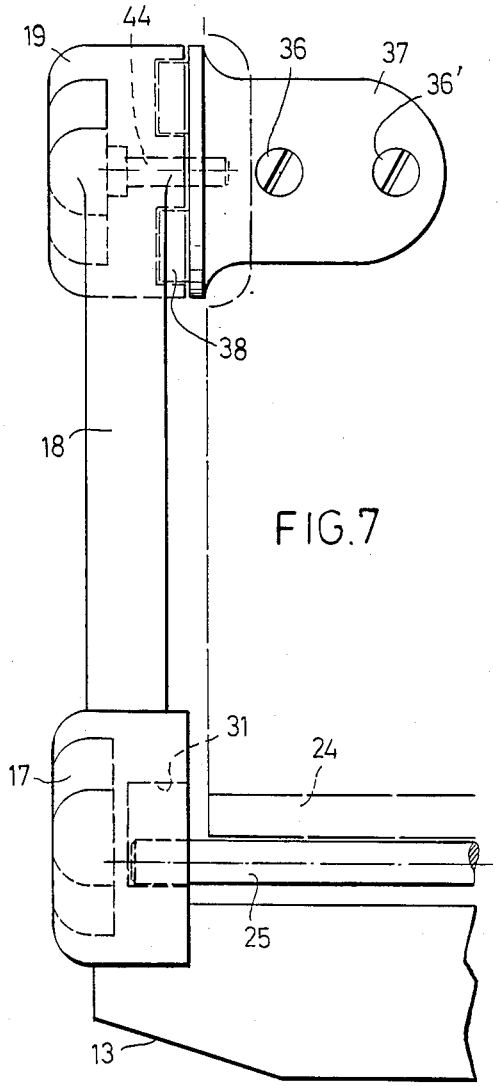
FIG. 7 is a front view, corresponding with the denoted area D of FIG. 2.

In mounting 19 a rotary spring 40 is positioned. To this end a mounting 37 is attached to the back 22 by means of two screws 36, 36' (see FIGS. 7 and 9) so that the mounting 37 extends into a free space 39 by means of a catch 38, the free space including a shaped piece the rotary spring 40 being of an elastomer, e.g. rubber. According to FIG. 5, the shaped piece 40 rests with one end against a radially extending wall 42 of the mounting 19, connected with the rising section 18, while its other end lies against the catch 38. When, as in FIG. 5, the back 22 is turned in the clockwise direction, the catch 38 turns correspondingly in the free space 39 and elastically compresses the shaped piece against the wall 42, so that an opposing force, as described above, is created in the direction of the arrow 26.

Figure 9:
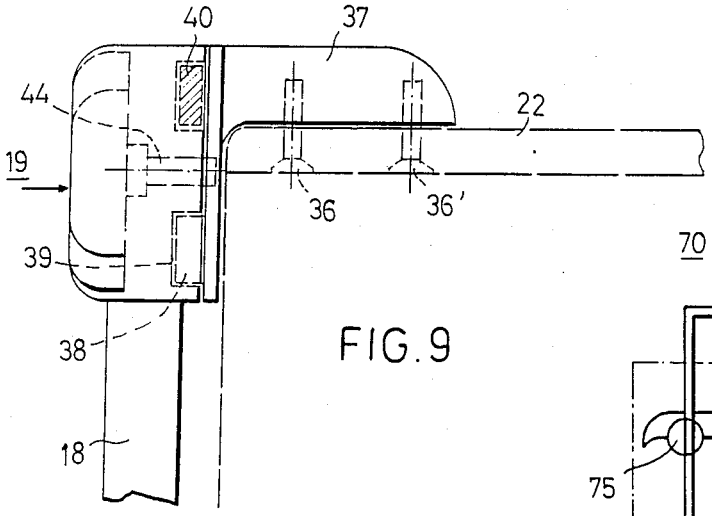
FIG. 9 is a section seen along the line IX—IX of FIG. 5.

As FIGS. 5 and 9 show in addition, the mounting 19 is attached rotatably to the mounting 37 by means of a screw 44.

A blocking-device 45, positioned in the cross-support 13, is released by means of an operating handle 46, the end of which is illustrated in FIG. 2 at 47. An operating handle for adjusting the height of the cross-support is shown at 48. The handle 46 is rotatably hinged at a bearing-frame 49. The bearing-frame 49 is attached at the cross-support 13. Thus when the operating handle 47 (FIG. 2) is pulled upward by the user, the handle 46 in FIG. 8 will turn around the bearing-frame 49 in a counter-clockwise direction, so that its interior, free end 46' (see FIG. 8), will go downward.

Figure 6:
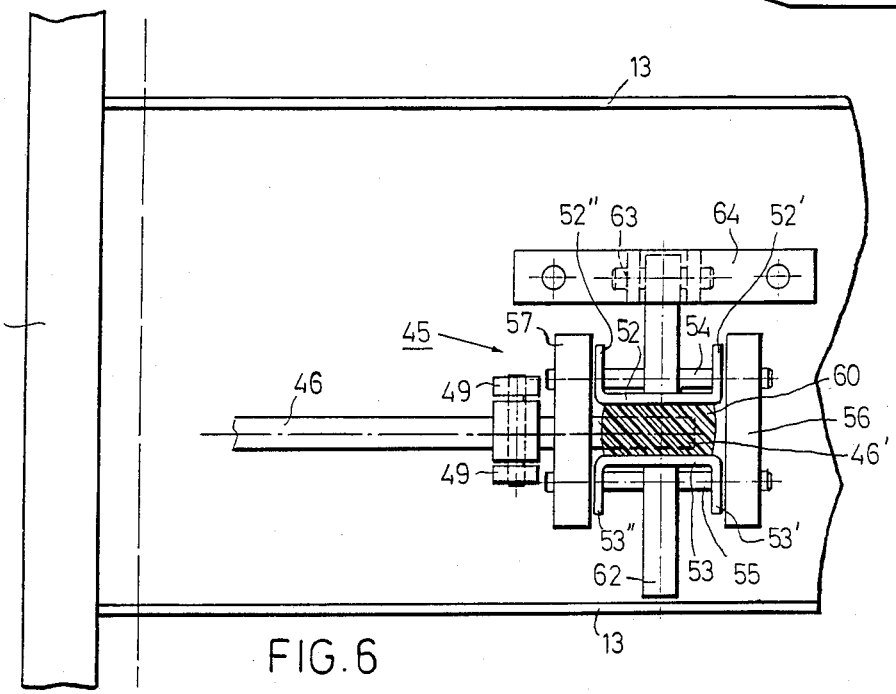
FIG. 6 is a top view of the blocking-device, seen along the arrows VI—VI of FIG. 4.

The end 46' is positioned between two clamping-elements 52, 53, which according to FIGS. 4 and 6 are each hinged at the bearing-frames 56, 57 by means of two turned offwelds 52', 52'' and 53', 53'' respectively and corresponding shafts 54, 55. The bearing-frames 56, 57 are attached to cross-support 13 (see in particular FIG. 8).

According to FIG. 4 the intermediate area between the clamping-elements 52, 53 diminishes in the downward direction, and the free end of 46' of the operating handle 46 is dimensioned such that on turning it downward the ends of the clamping-elements 52, 53 located there are forced away from each other. As a consequence thereof, with reference to FIG. 4, the clamping-element 52 is turned in the clockwise direction and the clamping-element 53 is turned in a counter-clockwise direction around the shafts 54 and 55, respectively.

Between the upper ends of the clamping-elements 52, 53 is a spring-device 60, here in the shape of a block of a suitable elastomer. The spring-device 60 presses the upper ends of the clamping-elements apart so that the lower ends of the clamping-elements move into their blocking-position, while on activation of the handle 46, the upper ends are turned in the direction towards each other—against the force of the spring-device 60—whereby the lower, blocking ends are separated.

Figure 8:
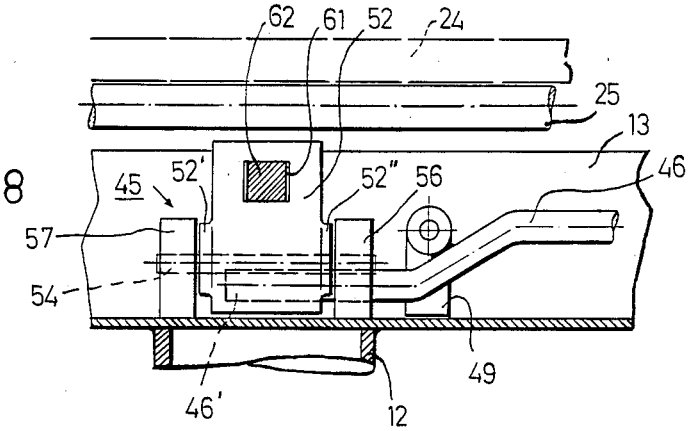
FIG. 8 is a section, seen along the line VIII—VIII of FIG. 4, and corresponding about with the denoted area E of FIG. 2.

According to FIG. 8 each one of the two clamping-elements 52, 53 has a rectangularly shaped free space or opening 61, through which extends a bar 62 of polygonal cross-section. In the example this cross-section is of square shape. As FIGS. 4 and 6 show, the bar 62 is connected with a mounting 64 by means of a shaft 63, which in turn is attached to the seat 24, and the shaft 63 extends through a longitudinal hole or slot 64' of mounting 64, so that a displacement in height of the seat 24 has no effect on the movements of the bar 62.

As shown in FIG. 4 due to the non-perpendicular orientation of the clamping-element 52 relative to the bar 62 and thus the engagement of the edges of opening 61 with corresponding surfaces of the bar 62, a movement of the bar 62 towards the left is blocked, while the clamping-element 53 blocks a movement of the bar 62 towards the right for similar reasons. If however the operating handle 46 is turned, so that its handle-end 46' moves downward, then the blocking is released. The clamping-elements 52 and 53 are advantageously hardened in the area of the openings or free spaces 61. A blocking of seat 24 in any desired position is therefore possible, as is a blocking in both directions of displacement.

FIGS. 10 to 17 show a second embodiment of the invention in the form of a desk-chair 70 (visitor chair) with a four legged frame 71, consisting of two substantially U-shaped frames 72, 73 and a cross-connection 74. According to FIG. 15 the frames 72, 73 may have a substantially oval cross-section, but may be also e. g. circular, square, etc. Two mountings 75, 76 are attached to each one of the frames 72, 73. The mounting 76 serves for connecting a back 77, which is connected with a seat 79 by means of a hinge 78.

The mounting 76 comprises, just as the mounting 13 of FIGS. 1 to 9, a rotary spring in the sense of the definition given in the introduction. The mounting 75 is similarly composed as the mounting 17 of FIGS. 1 to 9, and serves here as well for the longitudinal guidance of the seat 79 and to its lifting on forward displacement. If the seat 79 is shifted into its relaxation position (rest position) according to FIG. 12, then the rotary spring in the mounting 76 is put under tension, so that on release of the chair 70 it will move back its parts into their working position according to FIG. 10.

In addition a cross-bar 80 is provided at the bottom side of the seat 79, which is connected to the seat 79 and both ends of which are each positioned movable in an inclined longitudinal hole or slot 83 of the mounting 75. The mounting 75 is attached as shown to frames 72 and 73 respectively by means of two screws 84, 84'. The frames 72, 73 are further provided with a hole 85 each in the area of the mounting 75, in order to allow the introduction of the cross-bar 80 during assembly.

Figure 10:
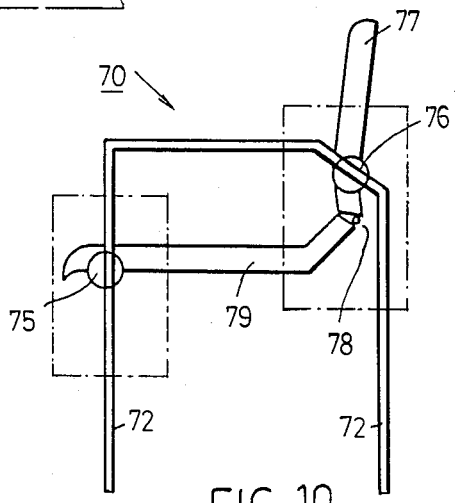
FIG. 10 illustrates a second embodiment of the invention in a side-view, depicted as a desk-chair in working position.
Figure 11:
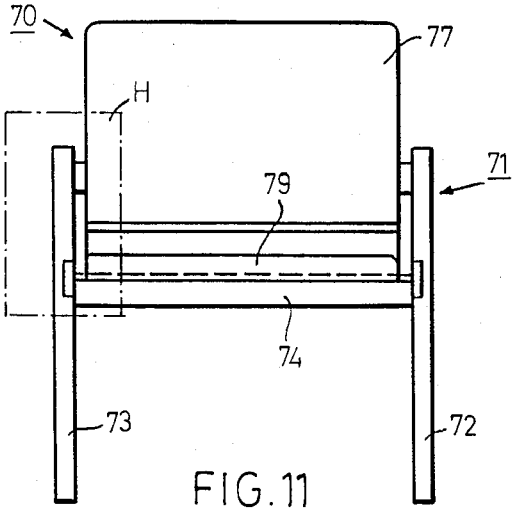
FIG. 11 is a front view of the desk-chair of FIG. 10.
Figure 12:
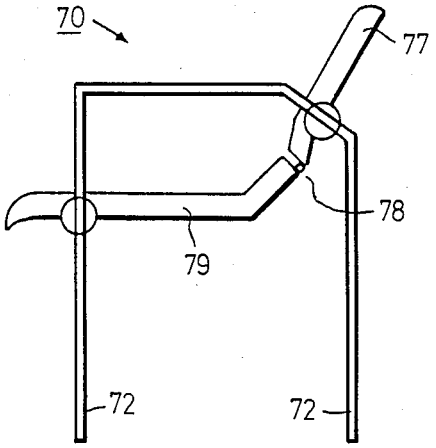
FIG. 12 is a side-view corresponding with FIG. 10, showing the chair in relaxation position (rest-position)
Figure 14:
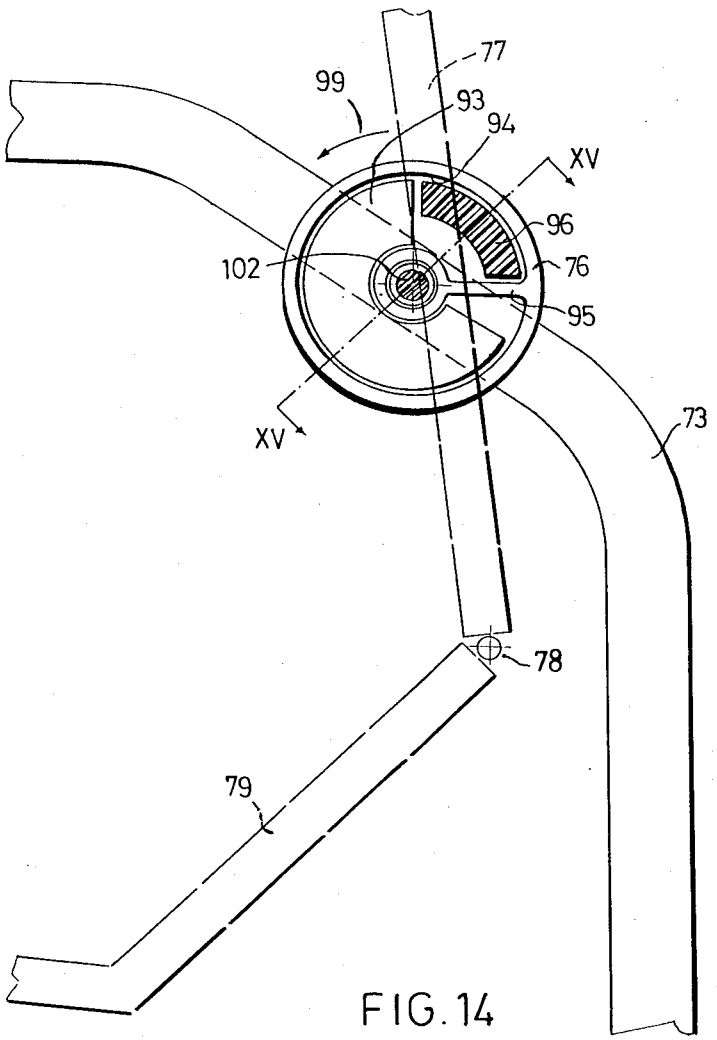
FIG. 14 is a section, seen along the line XIV—XIV of FIG. 16, through the rotary spring.
Figure 13:
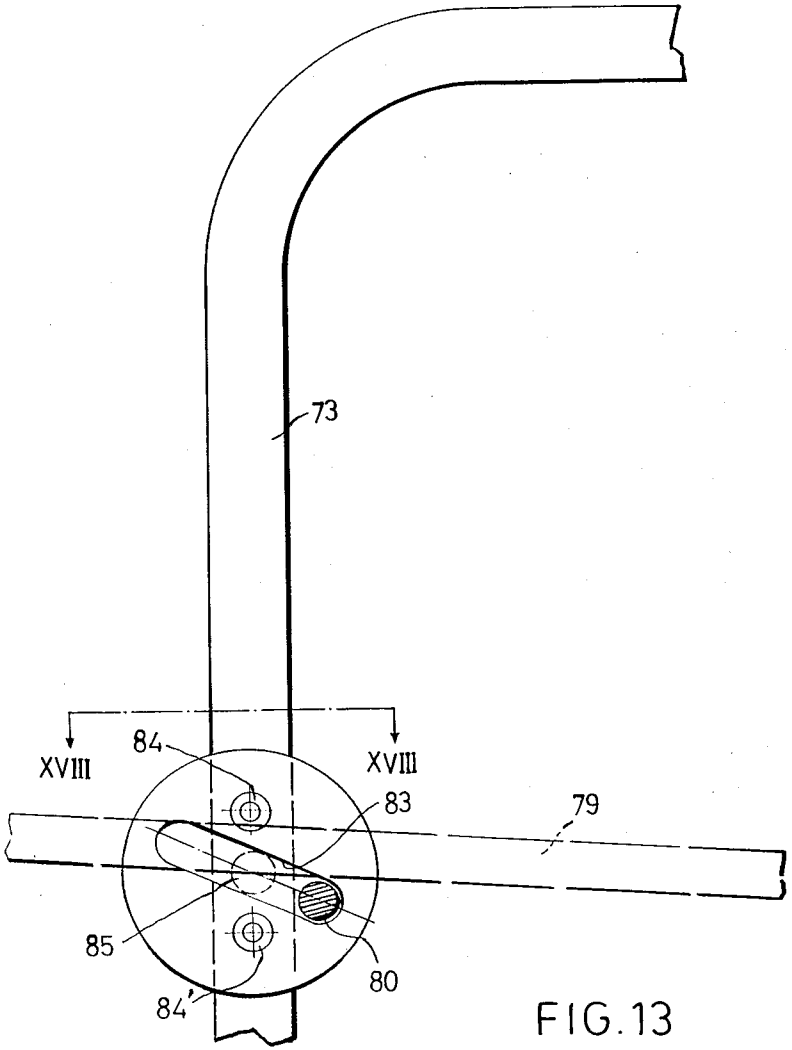
FIG. 13 is a section, seen along the line XIII—XIII of FIG. 16, which shows a mechanism for effecting seat-guidance by means of a sloping longitudinal hole.
Figure 16:
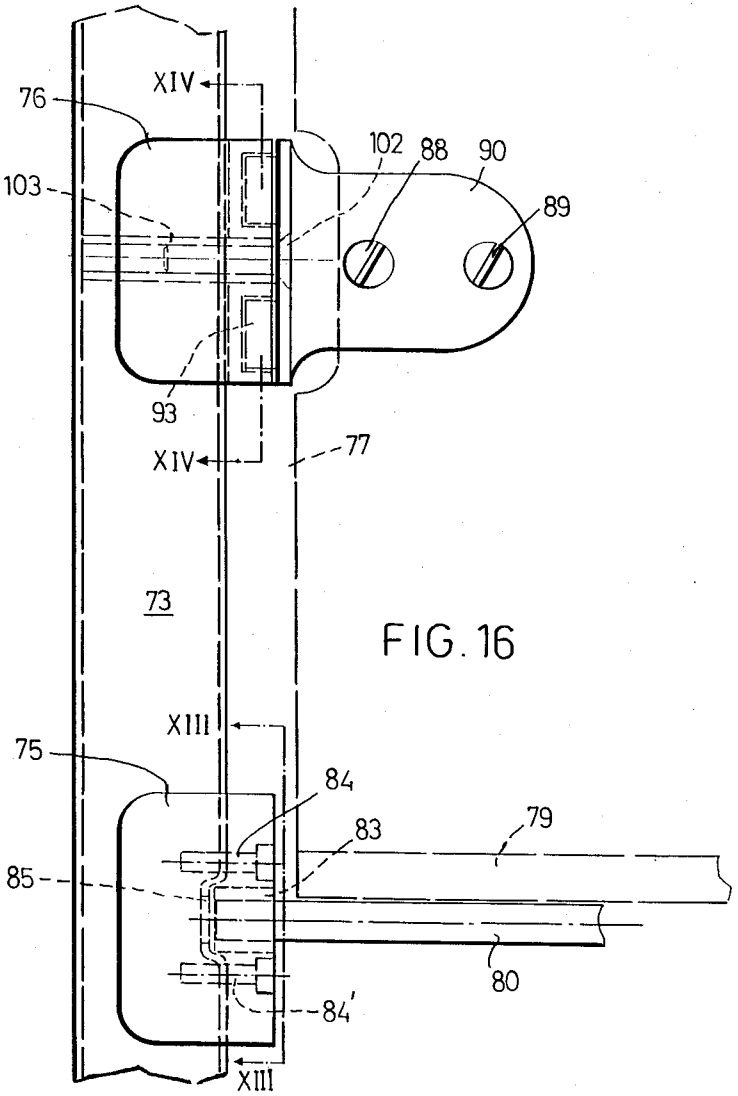
FIG. 16 is a front view corresponding with the denoted region H, shown with dash-dotted lines in FIG. 11.
Figure 15:
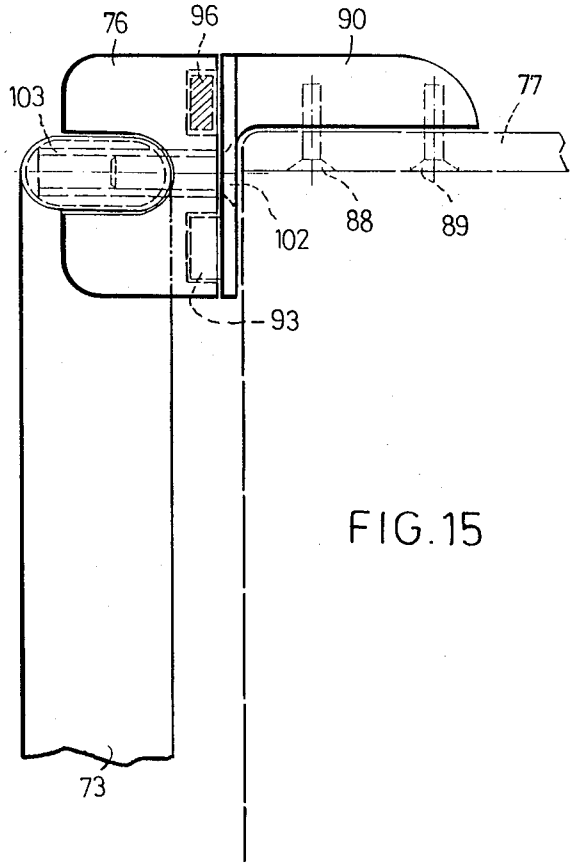
FIG. 15 is a section, seen along the line XV—XV of FIG. 14.
Figure 17:
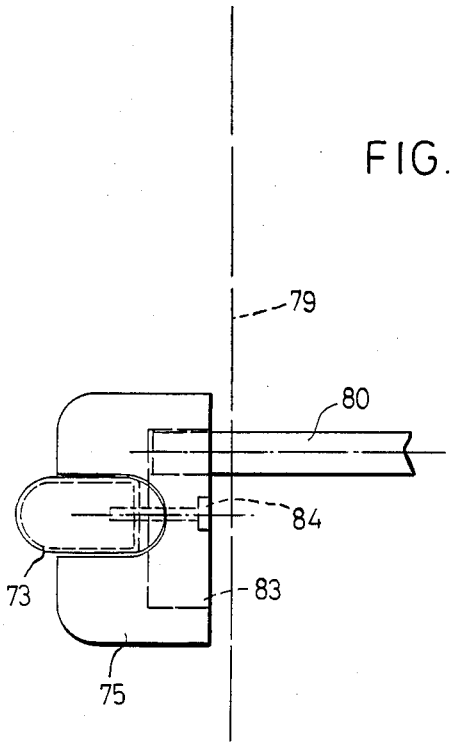
FIG. 17 is a top view, seen along the line XVII—XVII of FIG. 13, of a mounting arrangement for accepting the seat-guide.

The construction of the mounting 76 with the rotary spring follows from the FIGS. 14–16. According to FIGS. 15 and 16 a mounting part 90 is attached to the back 77 by means of two screws 88, 89, said mounting part 90 showing a catch 93 in the shape of a sector of a circle, which extends into a corresponding free space 94 of the mounting 76. This free space 94 is provided with a radially extending cross-wall 95 against which one end of a part 96 of an elastomeric material rests, the other end of the part 96 resting against the catch 93. If now in FIG. 14 the catch 93 is moved in the clockwise direction, then it compresses the part 96 elastically together, so that a corresponding opposing force is created, which tends to turn the back part 77 in the direction of the arrow 99 (FIG. 14) into its working position (FIG. 10).

For attachment of the mounting 76 (which according to FIG. 15 fits on the frame 73) and of the mounting part 90 on the frame 73 (respectively on the other side on frame 72) a screw 102 is provided, which is screwed into a screw-thread case 103 welded in into the frame 73 (72 respectively), which keeps the mounting part 90 at the mounting 76, and allows a turning of the mounting part 79 with respect to the mounting 76.

In the second embodiment according to FIGS. 10–17 no blocking-device is shown. Such an arrangement could however be provided if needed also for this embodiment.

Figure 18:
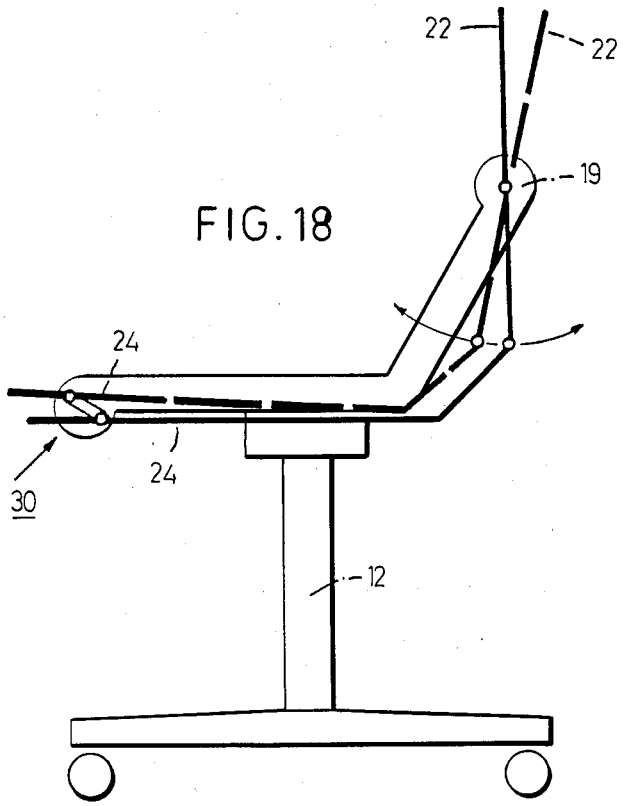
FIG. 18 is a schematic presentation of the change of the slope of the seat while changing from the working position to the rest-position.

FIG. 18 shows schematically the modification of the inclination of the seat 24 in various seat-positions. The working position according to FIG. 1 is shown in full lines, in which the back 22 is about vertical. The seat 24 has a substantially horizontal position, or is slightly inclined forward, as this is ergonomically favourable during work.

When reverting to the rest position, shown in dashed lines, the seat-guide 30 permits the seat 24 to assume a slight inclination backward, in order to prevent a slipping out from the sitting furniture. Thus one obtains continuously an ergonomically favourable working position. The seat-guide 30 causes only a slight lifting herein.

According to the invention a chair is thus obtained with very simple means, having outstanding use properties and an aesthetically pleasant, light and elegant appearance.

Within the scope of the present invention numerous variations and modifications are of course possible for those versed in the art, without going beyond the limits set by the specification and the claims.

I claim:

1. Sitting furniture, in particular a swivel chair (10;70) with a frame (15; 71), a seat having a front section and a rear section, (24; 79) and a back (22; 77) pivotably connected by a hinge (23) with the rear section of the seat, the back being pivotably mounted at two mounting positions, above the hinge (23), at a section of the frame extending rearwardly of the front section of the seat (19; 76), the seat being supported on the frame (15;71) by means of a seat-guide, provided at the front section of the seat, and being movable in forward and rearward directions corresponding to a rest position and a second working position respectively, and spring means (40; 96) for forcing the seat and back into the working position, the spring means (40; 96) in the area of at least one mounting position (19; 76) on said frame (15; 71), said at least one mounting position being positioned between the back (22; 77) and a section of the frame extending rearwardly of the front section of the seat (15; 71) above said hinge (23), an arcuate rotary spring at least partially surrounding said mounting position (19; 76), the rear section of the seat (24; 79) being rearwardly and upwardly inclined at an essentially fixed angle with respect to the front section of the seat, a guide means for the front section of the seat (24; 79) for the automatic adjustment of the slope of the seat, which corresponds to the slope of the back, the guide means including a longitudinal hole (31;83) for slidably receiving a cross bar (25) essentially transverse to a plane defined by the longitudinal hole (31; 83), the longitudinal hole (31; 83) being inclined upwardly and forwardly with respect to a plane tangential to a top surface of the front section of the seat (24; 79), whereby rearward rotation of the portion of the back above said at least one mounting position (19; 76) about said hinge (23) increases the angle between said seat (24; 79) and said back (22; 77) and causes said hinge (23) and said front and rear sections of said seat (24; 79) to move forward and upward, and forwardly and upwardly inclines said seat (24;79) so that a forwardmost portion of said front section of said seat (24; 79) is raised higher than a rearwardmost portion of the front section of said seat (24;79).

2. Sitting furniture according to claim 1, wherein said rotary spring rotates about the same axis, at the mounting position (19; 76), on which the back is pivotably mounted to said frame, and said spring means includes an open area (39; 94) in which an elastically compressible body (40;96) is located with one end adjoining a catch (42;95) disposed in said open area, and said spring means further includes means (38; 93) for accommodating an opposite end of said compressible body, so that on movement of the back (22;77) into its rest position, said compressible body is forced in direction against said catch (42; 95).

3. Sitting furniture according to claim 1, characterized in that a blocking-device (45) for blocking of the seat (24) against movement in a longitudinal direction is positioned within a cross-support (13) attached to and beneath the seat (24).

4. Sitting furniture according to claim 3, characterized in that the blocking-device is made for stageless blocking.

5. Sitting furniture, according to claim 4, characterized in that the blocking-device (45) has a blocking bar (62) connected with the seat (24), that this blocking bar (62) is provided with at least one clamping-element (52, 53) positioned within a cross-support (13) of the sitting furniture (10), said clamping-element having a free space (61) through which the blocking bar (62) extends, said free space (61), in the blocking position, being in clamping connection with the blocking bar (62).

6. Sitting furniture, according to claim 3, characterized in that the blocking-device (45) has a blocking bar (62) connected with the seat (24), and a clamping-element (52; 53) positioned within a cross-support beneath said seat 24 (13) of the sitting furniture (10), said clamping-element (52; 53) having a free space (61) through which the blocking bar (62) extends, a portion of said clamping element (52;53) immediately surrounding said free space (61), in the blocking position, being in clamping connection with the blocking bar (62).

7. Sitting furniture according to claim 6, characterized in that the blocking bar (62) has a cross-section deviating from circular cylinder form, in particular a polygonal cross-section.

8. Sitting furniture according to claim 6 characterized in that the blocking bar (62) is provided with two of said clamping-elements, said clamping elements (52; 53) being opposingly positioned with respect to each other for blocking in both directions of movement.

9. Sitting furniture according to claim 8 characterized in that the clamping-elements (52, 53) extend essentially transversely with respect to the blocking bar (62) in the blocking position.

10. Sitting furniture according to claim 9 characterized in that the connection (63) of the blocking bar (62) to the seat is made adjustable in height (64').

11. Sitting furniture according to claim 10 characterized in that a spring (60) is provided for exerting a force on at least one clamping-element (52, 53) in the clamping direction.

12. Sitting furniture according to claim 11, characterized in that the spring (60) is made as an elastomeric part between the two clamping-elements (52, 53).

13. Sitting furniture according to claim 1, wherein said essentially fixed angle is about 45°.

14. Sitting furniture according to claim 1, wherein said back section includes an upper portion extending upwardly from said mounting positions (19; 76) and a lower portion extending downwardly from said mounting positions (19; 76) to said hinge (23), said lower portion being forwardly inclined at an essentially fixed angle with respect to said upper portion.

15. Sitting furniture according to claim 14, wherein said rotary spring rotates about the same axis, at the mounting position (19; 76), about which the back is pivotably mounted to said frame, and said spring means includes an open area (39; 94) in which an elastically compressible body (40;96) is located with one end adjoining a catch 942;95) disposed in said open area, and said spring means further includes means (38; 93) for accommodating an opposite end of said compressible body, so that on movement of the back (22;77) into its rest position, said compressible body is forced in direction against said catch (42;95).

* * * * *